US009371967B2

(12) United States Patent
Kato et al.

(10) Patent No.: US 9,371,967 B2
(45) Date of Patent: Jun. 21, 2016

(54) LIGHTING APPARATUS WITH HEAT TRANSFER AND LIGHT GUIDING STRUCTURE

(75) Inventors: Mitsuaki Kato, Kanagawa-ken (JP); Katsumi Hisano, Chiba-ken (JP); Masataka Shiratsuchi, Kanagawa-ken (JP); Tomonao Takamatsu, Kanagawa-ken (JP); Tomoyuki Suzuki, Kanagawa-ken (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 176 days.

(21) Appl. No.: 13/597,558

(22) Filed: Aug. 29, 2012

(65) Prior Publication Data

US 2013/0223077 A1 Aug. 29, 2013

(30) Foreign Application Priority Data

Feb. 27, 2012 (JP) ..... 2012-040291

(51) Int. Cl.

| | |
|---|---|
| ***F21V 29/00*** | (2015.01) |
| ***F21V 7/00*** | (2006.01) |
| ***F21V 3/00*** | (2015.01) |
| ***F21V 5/00*** | (2015.01) |
| ***F21S 13/10*** | (2006.01) |
| ***H01J 1/02*** | (2006.01) |
| ***H01J 7/24*** | (2006.01) |
| ***H01J 61/52*** | (2006.01) |
| ***H01K 1/58*** | (2006.01) |
| ***F21K 99/00*** | (2016.01) |
| ***F21V 17/10*** | (2006.01) |

(52) U.S. Cl.

CPC . *F21K 9/135* (2013.01); *F21K 9/52* (2013.01); *F21V 17/101* (2013.01); *F21V 29/004* (2013.01)

(58) Field of Classification Search

CPC ..... H01K 1/30; H01K 1/46; F21K 9/135; F21K 9/52; F21K 9/13; F21V 29/2293; F21V 29/004; H01L 33/58

USPC ..... 362/294, 307, 311.02, 311.06, 363, 362/559, 565, 580; 313/45, 46

See application file for complete search history.

(56) References Cited

U.S. PATENT DOCUMENTS 6,218,785 B1 * 4/2001 Incerti ..... 315/185 S
6,499,860 B2 * 12/2002 Begemann ..... 362/230

(Continued)

FOREIGN PATENT DOCUMENTS

JP 2004-139186 5/2004
JP 2004-288570 10/2004

(Continued)

OTHER PUBLICATIONS

Japanese Office Action for Japanese Patent Application No. 2012-040291 mailed on May 5, 2014.

(Continued)

*Primary Examiner* — Jong-Suk (James) Lee
*Assistant Examiner* — Erin Kryukova
(74) *Attorney, Agent, or Firm* — Amin, Turocy & Watson LLP

(57) ABSTRACT

A lighting apparatus, comprising: a light source that emits light; a hollow heat-transfer member including an outer surface on which the light source is disposed; and a light guiding member that covers the light source and at least part of the outer surface along the outer surface.

25 Claims, 8 Drawing Sheets

(56) References Cited

U.S. PATENT DOCUMENTS

| | | | | |
|---|---|---|---|---|
| 7,086,756 | B2 * | 8/2006 | Maxik | 362/249.04 |
| 7,160,012 | B2 * | 1/2007 | Hilscher et al. | 362/555 |
| 7,824,065 | B2 * | 11/2010 | Maxik | 362/234 |
| 7,926,975 | B2 * | 4/2011 | Siemiet et al. | 362/240 |
| 8,414,160 | B2 * | 4/2013 | Sun et al. | 362/294 |
| 8,425,086 | B2 * | 4/2013 | Chen et al. | 362/294 |
| 8,487,518 | B2 * | 7/2013 | Johnston et al. | 313/46 |
| 8,596,821 | B2 * | 12/2013 | Brandes et al. | 362/249.02 |
| 8,657,470 | B2 * | 2/2014 | Jen et al. | 362/285 |
| 8,761,565 | B1 * | 6/2014 | Coleman et al. | 385/146 |
| 2008/0304249 | A1 | 12/2008 | Davey et al. | |
| 2009/0086492 | A1 * | 4/2009 | Meyer | 362/294 |
| 2009/0195186 | A1 * | 8/2009 | Guest et al. | 315/294 |
| 2009/0302730 | A1 * | 12/2009 | Carroll et al. | 313/46 |
| 2010/0181888 | A1 * | 7/2010 | Lu | 313/46 |
| 2011/0032708 | A1 | 2/2011 | Johnston et al. | |
| 2011/0074290 | A1 * | 3/2011 | Sakai et al. | 315/32 |
| 2011/0101861 | A1 * | 5/2011 | Yoo | 315/35 |
| 2011/0141747 | A1 * | 6/2011 | Biar | 362/311.06 |
| 2011/0234076 | A1 * | 9/2011 | Simon et al. | 313/46 |
| 2011/0248619 | A1 * | 10/2011 | Loh | 313/46 |
| 2011/0291560 | A1 * | 12/2011 | Wang et al. | 315/32 |
| 2012/0127734 | A1 | 5/2012 | Tanimoto et al. | |
| 2012/0139403 | A1 | 6/2012 | Johnston et al. | |
| 2012/0218768 | A1 | 8/2012 | Hisano et al. | |

FOREIGN PATENT DOCUMENTS

| | | |
|---|---|---|
| JP | 2008-084696 | 4/2008 |
| JP | 2010-015754 | 1/2010 |
| JP | 2010-040364 | 2/2010 |
| JP | 2010-198807 | 9/2010 |
| JP | 2012-003932 | 1/2012 |
| JP | 2012-146552 | 8/2012 |
| WO | 2011/030562 | 3/2011 |
| WO | 2011-030562 | 3/2011 |

OTHER PUBLICATIONS

Japanese Office Action for Japanese Patent Application No. 2014-254614 mailed on Aug. 28, 2015.

Office Action of Notice of Reasons for Refusal for Japanese Patent Application No. 2014-254614 dated Mar. 18, 2016, 7 pages.

* cited by examiner

LIGHTING APPARATUS WITH HEAT TRANSFER AND LIGHT GUIDING STRUCTURE

CROSS-REFERENCE TO RELATED APPLICATION

This application is based upon and claims the benefit of priority from Japanese Patent Application No. P2012-040291, filed on Feb. 27, 2012; the entire contents of which are incorporated herein by reference.

FIELD

Embodiments of the present invention relate to a lighting apparatus.

BACKGROUND

In general, a lighting apparatus using light emitting diodes (LEDs), in which the LEDs that generate light are arranged in one surface of a base and a spherical globe is provided to cover the LEDs, diffuses and transfers light from the LEDs to an outside. Such a lighting apparatus transfers heat from the LEDs to the base and transfers the heat to the outside from another surface (heat transfer surface) of the base, which is held in contact with the ambient air.

It is desirable that the lighting apparatus using the LEDs have total luminous flux (measure indicating brightness of light emitted by LEDs) that is approximately equal to that of a lighting apparatus (incandescent bulb or the like) using a typical filament or the like.

In order to increase the total luminous flux, it is necessary to use LEDs having higher luminance, which correspondingly increases an amount of heat generation of the LEDs. The heat generated by the LEDs influences elements of the LEDs themselves, a circuit board such as a power circuit, and the like, so that the performance of the elements of the LEDs, the circuit board, and the like is deteriorated. Therefore, in order to enhance heat transfer performance of the lighting apparatus, it is necessary to increase a surface area of a heat transfer surface of the base.

Therefore, in order to enhance the heat transfer performance, it is necessary to increase the size of the lighting apparatus.

A lighting apparatus having an enhanced heat transfer performance without increasing the size of the lighting apparatus is provided.

A lighting apparatus according to an embodiment includes: a light source that emits light; a hollow heat-transfer member including an outer surface on which the light source is disposed; and a light guiding member that covers the light source and at least part of the outer surface along the outer surface.

DETAILED DESCRIPTION

Hereinafter, embodiments for carrying out the present invention will be described.

First Embodiment

FIG. 1 are configuration diagrams of a lighting apparatus 100 according to a first embodiment. Specifically, FIG. 1A is a full view of the lighting apparatus 100. FIG. 1B is a cross-sectional diagram of the lighting apparatus 100 that is taken along a plane including the axis (A-A line) of FIG. 1A. FIG. 1C is an overhead view of the lighting apparatus 100 as viewed in the arrow X direction of FIG. 1A. FIG. 1D is an enlarged view of an area (S1) surrounded by the dashed line of FIG. 1B.

Hereinafter, a configuration of the lighting apparatus 100 will be described in detail.

A case where the lighting apparatus 100 is mounted to a socket provided in a room ceiling is assumed as an example in this embodiment. In this case, a direction of gravitational force is defined as a lower side and a ceiling direction is defined as an upper side with the lighting apparatus 100 being a reference.

Figure 1A:
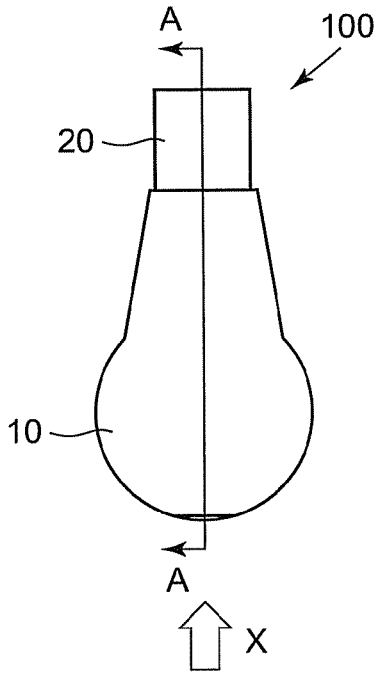
FIG. 1 are configuration diagrams of a lighting apparatus according to a first embodiment.

The lighting apparatus 100 in FIG. 1A includes a globe portion 10 and a cap portion 20. The globe portion 10 emits light from a surface thereof when the lighting apparatus 100 functions as a lighting unit. The cap portion 20 serves as an electrical and mechanical connection when the lighting apparatus 100 is fixed to the socket (not shown) by, for example, screwing. It should be noted that the lighting apparatus 100 has a symmetrical shape about the axis of FIG. 1A in this embodiment. Hereinafter, this axis (symmetrical axis of lighting apparatus 100) is referred to as a center axis of the lighting apparatus 100.

As shown in FIG. 1, under a state in which the lighting apparatus 100 is mounted to the socket with a center axis direction of the lighting apparatus 100 corresponding to the direction of gravitational force, the cap portion 20 of the lighting apparatus 100 is provided on the upper side and the globe portion 10 of the lighting apparatus 100 is provided on the lower side. When a room power source or the like feeds power to the socket, the globe portion 10 emits light from the surface thereof so that the lighting apparatus 100 functions as the lighting unit.

(Globe Portion)

As shown in FIG. 13, the globe portion 10 includes a hollow heat-transfer member 11, a light guiding member 12, a light source 13, and a first member 14. The light guiding member 12 is provided to cover the heat-transfer member 11 along the shape of the heat-transfer member 11. The light source 13 is disposed on a surface of the heat-transfer member 11. The first member 14 is provided in contact with the light guiding member 12 and opposed to the light source 13 via the light guiding member 12.

The heat-transfer member 11 is a member that transfers, inside the heat-transfer member 11, heat generated by the light source 13 and transfers part of the heat to the light guiding member 12. The heat-transfer member 11 has, for example, a typical bulb shape as shown in FIG. 1. Specifically, as shown in the figures, the heat-transfer member 11 includes a spherical head portion 11*a* and a circular truncated cone shaped body portion 11*b*, the spherical head portion 11*a* and the body portion 11*b* being integrally formed. The body portion 11*b* includes an opening at one end thereof in the center axis direction. It should be noted that a metal material excellent in thermal conductivity, for example, an aluminum is desirably used as a material of the heat-transfer member 11. Incidentally, the heat-transfer member 11 is filled with the air. A reduced-pressure atmosphere lower than the atmospheric pressure may be adopted. Hereinafter, a surface of the heat-transfer member 11 on a hollow side thereof is defined as a first inner surface and a surface on an opposite side to the first inner surface is defined as a first outer surface (surface).

The light guiding member 12 is a light transmissive member that is made of, for example, glass or a synthetic resin and guides light therein. Regarding the shape of the light guiding member 12, the light guiding member 12 includes a spherical head portion 12*a* and a circular truncated cone shaped body portion 12*b* similar to the heat-transfer member 11. Hereinafter, a surface of the light guiding member 12, which is held in direct contact with the first outer surface of the heat-transfer member 11 or indirect contact with the first outer surface via a sheet (not shown) that will be described later is defined as a second inner surface and a surface on an opposite surface to the second inner surface is defined as a second outer surface (surface). The second inner surface or the second outer surface of the light guiding member 12 is provided, over its entire surface, with scattering marks 30 for scattering light. The scattering marks 30 are formed by, for example, serigraph or cutting.

It should be noted that the first outer surface of the heat-transfer member 11 and the second inner surface of the light guiding member 12 may be bonded to each other (fixed to each other in in-contact state) by a heat-transfer thermal grease, an adhesive, or the like that is excellent in thermal conductivity (e.g., thermal conductivity of from 1.0 to 100 W/mK). That is because, as will be described later, when the heat of the heat-transfer member 11 is transferred to the outside of the lighting apparatus 100 via the light guiding member 12, it is desirable that contact thermal resistance between the heat-transfer member 11 and the light guiding member 12 be desirably as low as possible.

Further, when the lighting apparatus 100 functions as the lighting unit, an area of the light guiding member 12 near the light source 13 is highly heated (approximately 125° C.). Therefore, a polycarbonate (90% of visible light transmittance), a cycloolefin polymer (92% of visible light transmittance), or the like, which is excellent in thermal resistance, is desirably used as a material of the light guiding member 12.

The light source 13 is a chip including a plate-like substrate including one surface on which one or more light emitting elements (not shown) such as light emitting diodes (LEDs) are mounted. The light source 13 generates visible light, for example, white light. For example, in the case where a light emitting element that generates bluish-purple light having a wavelength of 450 nm is used, this light emitting element is sealed with a resin material or the like that contains a fluorescent substance to absorb the bluish-purple light and generate yellow light having a wavelength of approximately 560 nm. In this manner, the bluish-purple light and the yellow light are mixed together, so that the light source 13 generates the white light.

The light source 13 is desirably provided on the first outer surface of the heat-transfer member 11 such that a surface of the light source 13 on an opposite side to the surface of the substrate, on which the light emitting elements are provided, is held in contact with the first outer surface via a heat-transfer sheet (not shown) having electrical insulation property and being excellent in thermal conductivity. That is because, as will be described later, in order to transfer the heat generated by the light source 13 to the heat-transfer member 11, it is desirable that contact thermal resistance between the light source 13 and the heat-transfer member 11 be as low as possible and an electrical insulation relationship be established between the light source 13 and the heat-transfer member 11. Further, at this time, the surface of the light source 13, on which the light emitting elements are provided, is brought into contact with the second inner surface of the light guiding member 12.

In this manner, for disposing the light source 13 on the first outer surface of the heat-transfer member 11, it is possible to appropriately determine a setting position of the light source 13 between the heat-transfer member 11 and the light guiding member 12 in the design phase of the lighting apparatus 100. Therefore, a degree of freedom of a disposition position of the light source 13 increases.

In this embodiment, in a state in which the lighting apparatus 100 is mounted to the socket, the light source 13 is located at an end of the lighting apparatus 100 between the heat-transfer member 11 and the light guiding member 12, the end being positioned at the lowermost position of the lighting apparatus 100 in the center axis direction (i.e., direction of gravitational force). More specifically, the light source 13 is located at an end of the spherical head portion 11*a*.

As will be described later, the air around the lighting apparatus 100 flows in a direction opposite to the direction of gravitational force due to natural convection. By providing the light source 13 at the end in the direction of gravitational force as described above, it is possible to efficiently cool the globe portion 10 by the air having a lower temperature.

The first member 14 is a member that reflects into the light guiding member 12 part of light, which is inputted from the light source 13 into the light guiding member 12, and that transmits therethrough the remained light to an external space of the lighting apparatus 100. The first member 14 is held in contact with the light guiding member 12 in a state in which the heat-transfer member 11 and the light guiding member 12 are fixed. Further, at this time, the first member 14 is provided in a position to be opposed to the light source 13 via the light guiding member 12 such that a curved surface of the first member 14 faces the light source 13. For example, a beam splitter may be used for the first member 14.

It should be noted that the first member 14 only needs to reflect part of light from the light source 13 into the light guiding member 12, and hence a member that scatters light, for example, an opalescent glass, an opalescent acryl, or an opalescent polycarbonate may be used as the first member 14 instead of the beam splitter. In this case, part of scattered light becomes light reflected into the light guiding member 12.

(Cap Portion)

Figure 1B:
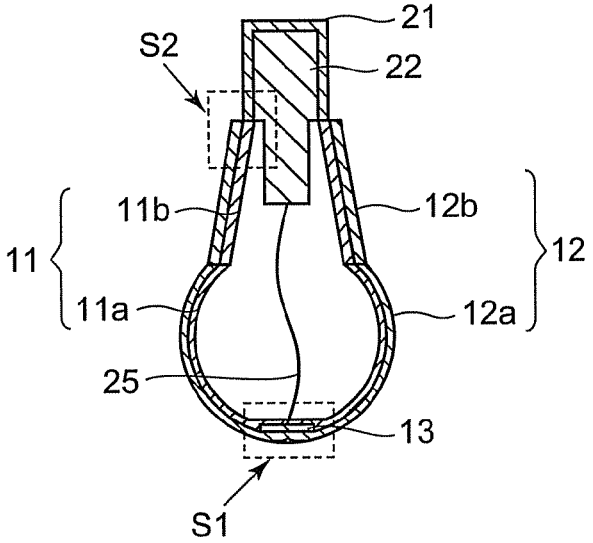
Figure 1C:
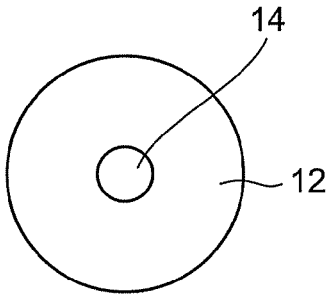
Figure 1D:
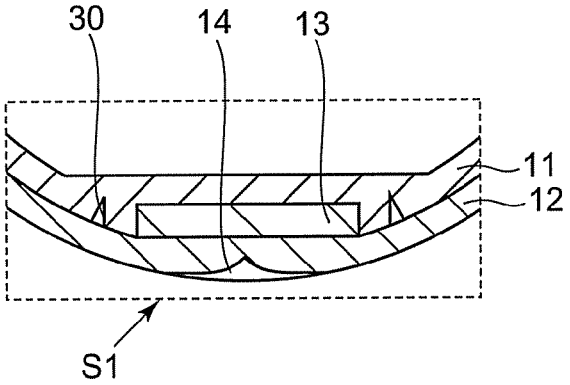

As shown in FIG. 1B, the cap portion 20 includes a conductive mounting member 21 and a power circuit 22. The mounting member 21 is provided in an opening of the heat-transfer member 11. The power circuit 22 is provided in the mounting member 21 to supply power to the light source 13.

The mounting member 21 is a member including a surface internally or externally threaded so as to be mounted to the socket. The mounting member 21 has a hollow cylinder-shaped member being opened at one end thereof and having a rotation axis to be a rotation center when the mounting member 21 is mounted to the socket in this embodiment. A metal material such as conductive aluminum is desirably used as a material of the mounting member 21. It should be noted that the rotation axis of the mounting member 21 corresponds to the center axis of the lighting apparatus 100 in this embodiment.

The power circuit 22 is provided while being sealed in, for example, a resin case 23. The resin case 23 is fixed inside the mounting member 21. The power circuit 22 supplies power from the socket to the light source 13. Specifically, an alternating-current voltage is applied from the room socket, and hence the power circuit 22 receives the alternating-current voltage (e.g., 100 V), converts it into a direct-current voltage, and then applies the direct-current voltage to the light source 13. It should be noted that the mounting member 21 and the power circuit 22 are electrically connected to each other. Further, the power circuit 22 and the light source 13 are electrically connected to each other through a wiring 25.

It should be noted that, in some interior designs, when the lighting apparatus 100 is mounted to the socket, the center axis direction of the lighting apparatus 100 may not correspond to the direction of gravitational force. In this case, the light source 13 does not necessarily need to be provided at the end of the lighting apparatus 100 in the center axis direction. In a state in which the lighting apparatus 100 is mounted to the socket, the light source 13 is desirably provided at an end of the heat-transfer member 11 in the direction of gravitational force. At this time, an electrical insulation relationship is established between the heat-transfer member 11 and the mounting member 21 and the heat-transfer member 11 is connected to the mounting member 21 to be rotatable about the rotation axis.

Accordingly, when the lighting apparatus 100 is mounted to the socket, in the case where the center axis direction of the lighting apparatus 100 does not correspond to the direction of gravitational force, it is possible to set the position of the light source 13 to be closer to the end of the heat-transfer member 11 in the direction of gravitational force by, for example, a user manually rotating the globe portion 10.

Figure 2:
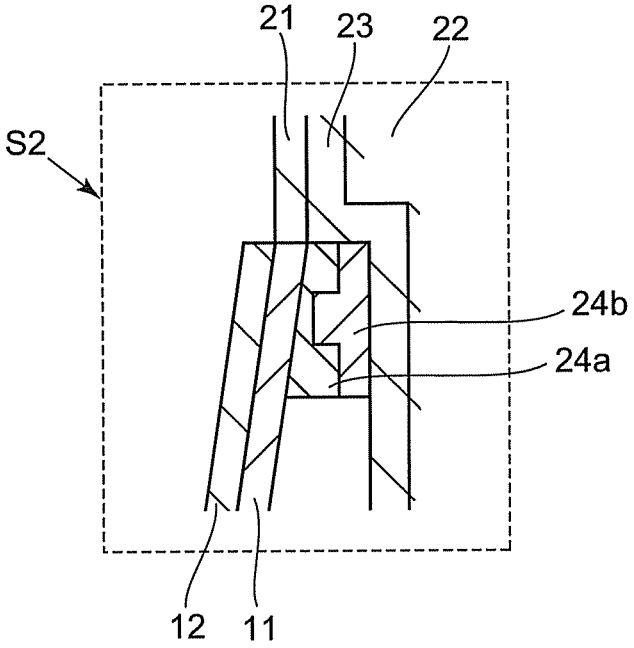
FIG. 2 is a configuration diagram showing an example of a rotation mechanism of a mounting member to be used in the lighting apparatus according to the first embodiment.

FIG. 2 is a diagram showing an example of a rotation mechanism of the mounting member 21. Specifically, FIG. 2 is an enlarged view of an area (S2) surrounded by the dashed line of FIG. 1B. In the example of FIG. 2, a first fitting member 24*a* provided to the first inner surface of the heat-transfer member 11 is fitted onto a second fitting member 24*b* provided to the case 23 fixed in the mounting member 21, to thereby realize rotation of the mounting member 21. At this time, a stopper (not shown) may be provided to limit an angle of rotation to within a predetermined range.

(Description of Function)

Hereinafter, referring to FIGS. 3 to 7, a function of the lighting apparatus 100 will be described in detail.

Figure 3:
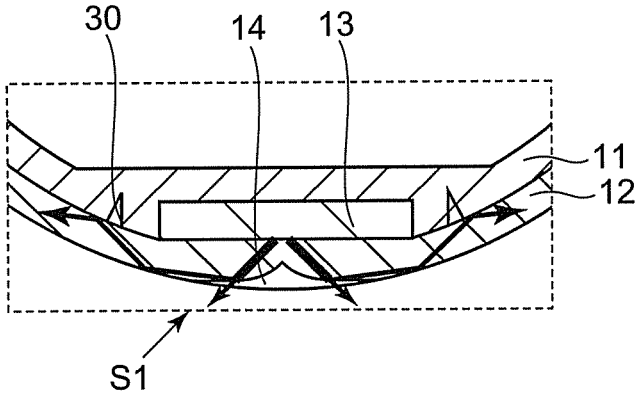
FIG. 3 is an explanatory diagram of a function of a first member to be used in the lighting apparatus according to the first embodiment.
Figure 4A:
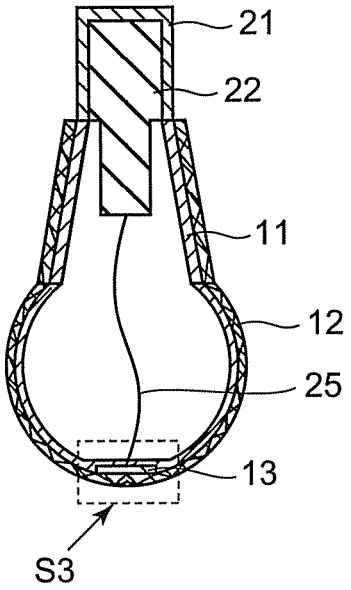
FIG. 4 are explanatory diagrams of a function of a light guiding member to be used in the lighting apparatus according to the first embodiment.
Figure 4B:
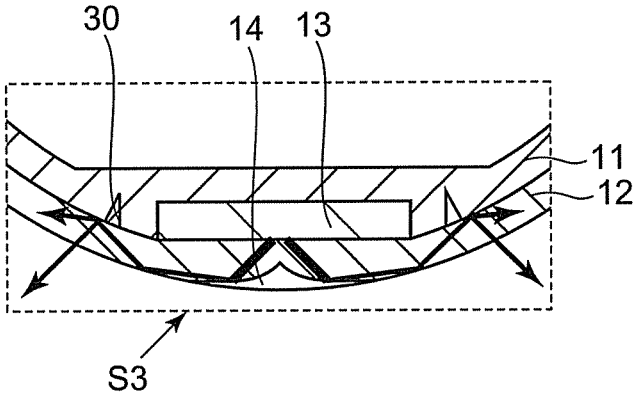
Figure 5:
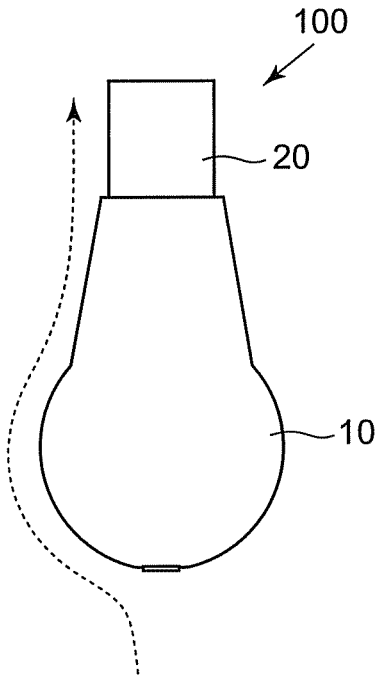
FIG. 5 is an explanatory diagram of an air flow around the lighting apparatus according to the first embodiment.

FIG. 3 is an explanatory diagram of a function of the first member 14. FIG. 4 are explanatory diagrams of a function of the light guiding member 12. FIG. 5 is an explanatory diagram of an air flow around the lighting apparatus 100.

When the room power source or the like feeds power to the socket in a state in which the cap portion 20 of the lighting apparatus 100 is mounted to the socket provided in the room ceiling or the like, an alternating-current voltage is supplied to the power circuit 22 via the mounting member 21 of the cap portion 20. In addition, a constant current is supplied to the light source 13 via the power circuit 22. Accordingly, the light source 13 transfers light.

The light transferred from the light source 13 is inputted into the first member 14 provided in the position to be opposed to the light source 13. Then, part of the light travels in a straight line through the first member 14 or is refracted by the first member 14 and transmitted to the external space of the lighting apparatus 100 (FIG. 3).

Further, the part of the light is reflected on an interface between the light guiding member 12 and the first member 14 and inputted into the light guiding member 12. Light out of the light, which satisfies a total reflection condition on the interface between the light guiding member 12 and the external space (angle of reflection $\theta$>critical angle $\theta m$), repeats total reflections on the interface between the light guiding member 12 and the external space and an interface between the light guiding member 12 and the heat-transfer member 11 and is guided (propagates) inside the light guiding member 12 (FIG. 4A).

Light that is scattered by the scattering marks 30 and does not satisfy the above-mentioned total reflection condition is outputted from the light guiding member 12 to the external space without being totally reflected on the interface between the light guiding member 12 and the external space. Accordingly, the second outer surface of the light guiding member 12, that is, the entire surface of the globe portion 10 emits light (FIG. 4B).

At this time, heat generates in the light source 13 due to light emission by the light emitting elements. This heat is transferred from the light source 13 to the heat-transfer member 11 via the sheet. Then, the heat transferred to the heat-transfer member 11 propagates inside the heat-transfer member 11. In addition, the heat propagating inside the heat-transfer member 11 is transferred from the heat-transfer member 11 to the light guiding member 12. At this time, as described above, the members excellent in thermal conductivity establish thermal connections between the light source 13 and the heat-transfer member 11 and between the heat-transfer member 11 and the light guiding member 12, and hence it is possible to efficiently propagate the heat.

Further, the light source 13 is held in contact with the light guiding member 12, and hence it is possible to directly propagate the heat to the light guiding member 12 without the heat-transfer member 11.

As described above, the heat transferred to the light guiding member 12 is transferred from the second outer surface of the light guiding member 12 to the external space of the lighting apparatus 100. At this time, it is possible to perform the heat transfer from the entire second outer surface of the light guiding member 12. Therefore, it is possible to efficiently transfer the heat from the lighting apparatus 100 by the heat transfer over a large area.

Although the configuration in which the light guiding member 12 covers the entire first outer surface of the heat-transfer member 11 has been described as the example in this embodiment, a configuration in which part of the heat-transfer member 11 (e.g., only the head portion 11*a*) is covered may be adopted. In this case, in addition to heat transfer from the second outer surface of the light guiding member 12, it is also possible to directly transfer heat from the first outer surface of the heat-transfer member 11.

The heat transfer from the light guiding member 12 is influenced by the thermal resistance of the light guiding member 12. Thermal resistance R (K/W) of a flat plate having a thickness l (m), a surface area A ($m^2$), and thermal conductivity k (W/mK) is expressed by l/(kA). In order not to inhibit the heat transfer from the light guiding member 12, it is desirable to set the thermal resistance R to 3 (K/W) or less.

For example, when the light guiding member 12 has a thickness l=0.005 (m) and a surface area A=0.01 ($m^2$), the thermal resistance is approximately 2.5 (K/W) in the case of using a polycarbonate or an acryl (thermal conductivity of k≈0.2 (W/mK)) or approximately 0.4 (K/W) in the case of using glass (thermal conductivity of k≈1.25 (W/mK)).

The heat transferred from the lighting apparatus 100 increases the ambient temperature of the lighting apparatus 100. Then, as shown in FIG. 5, the warmed-up air ascends, due to natural convection, specifically, in the direction opposite to the direction of gravitational force through the surface of the globe portion 10 and the surface of the cap portion 20 along the outline of the lighting apparatus 100. This air flow allows the surface of the lighting apparatus 100 to be further cooled.

At this time, as the air ascends along the outline of the lighting apparatus 100, the temperature of the flowing air gradually increases. In other words, the air on an upstream side near the end of the globe portion 10 in the direction of gravitational force has a lowest temperature and the air on a downstream side increases in temperature as it comes closer to the cap portion 20. On the other hand, in the globe portion 10, the air near the light source 13 has a highest temperature.

The heat-transfer in which the heat is transferred from the lighting apparatus 100 is influenced by a difference between the temperature of the surface of the lighting apparatus 100 and the temperature of the ambient air (hereinafter, referred to as temperature difference ΔT). In other words, an amount of heat transferred due to the heat-transfer is proportional to the temperature difference ΔT.

Thus, by providing the light source 13 at the end of the heat-transfer member 11 in the direction of gravitational force as in this embodiment, it is possible to set ΔT to be larger than in the case of providing it on the downstream side. Thus, it is possible to efficiently cool the globe portion 10 by the air having a lower temperature than on the upstream side.

In addition, the light source 13 is provided in the position relatively close to the surface of the globe portion 10, and hence it is possible to directly transfer most of heat from the light source 13 from the light guiding member 12 to the outside. Thus, it is possible to efficiently cool the globe portion 10.

Further, in this embodiment, the disposition position of the light source 13 is at the end of the lighting apparatus 100 in the center axis direction, and hence the light from the light source 13 is symmetrically guided inside the light guiding member 12. Thus, it is possible to achieve more uniform luminance distribution over the entire surface of the light guiding member 12. In other words, it is possible to reduce the nonuniformity of the luminance distribution in the second outer surface of the light guiding member 12.

It should be noted that the lighting apparatus 100 in this embodiment may be produced by causing, in a state in which the heat-transfer member 11 is provided with the light source 13, two light guiding members 12 divided in each cross-section thereof including the center axis to adhere to the heat-transfer member 11 and similarly bonding the cross-sections of the divided light guiding members 12 to each other by a thermal grease, an adhesive, and the like.

Figure 6:
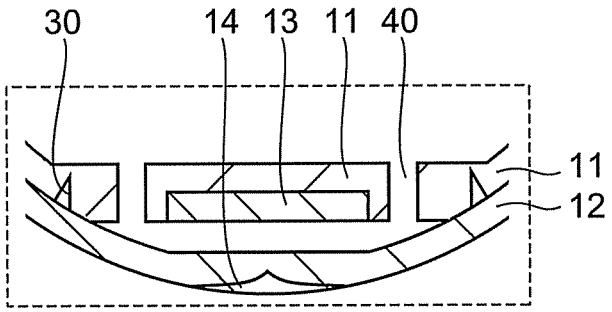
FIG. 6 is a configuration diagram showing a first modification of the lighting apparatus according to the first embodiment.
Figure 7:
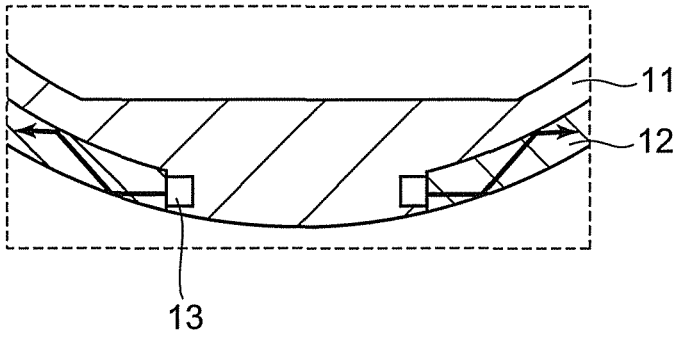
FIG. 7 is a configuration diagram showing a second modification of the lighting apparatus according to the first embodiment.

Although the case where the light source 13 and the light guiding member 12 are held in contact with each other has been described as the example, a configuration in which as in a first modification shown in FIG. 6, the light source 13 and the light guiding member 12 are opposed to each other while sandwiching a space therebetween. In this case, by, for example, providing the heat-transfer member 11 with openings 40 that cause a space between the light source 13 and the light guiding member 12 and a space inside the heat-transfer member 11 to communicate with each other, the air having an temperature increased due to heat of the light source 13 is forced to circulate inside the heat-transfer member 11 and to be transferred to the external space of the lighting apparatus 100 through an opening (not shown). In this manner, it is possible to immediately cause the high-temperature air to flow away from the light source 13.

Further, although the example in which the material capable of transmitting therethrough part of the light from the light source 13 is used as the first member 14 has been described, a metal material may be used, for example. In this case, light is not transferred directly beneath the first member 14 and higher-intensity light is guided into the light guiding member 12. Further, as in a second modification shown in FIG. 7, light sources 13 may be provided on side surfaces of the heat-transfer member 11 so that light from the light sources 13 is inputted along the second inner surface (or second outer surface) of the light guiding member 12. In this case, the first member 14 does not necessarily need to be provided.

According to the lighting apparatus 100 of this embodiment, the light source 13 is provided between the heat-transfer member 11 and the light guiding member 12, and hence it is possible to achieve efficient heat transfer. Further, it is possible to enhance heat transfer performance of the lighting apparatus 100.

Further, in comparison with the generally-used LED lighting apparatus as mentioned in the Background section, the base for supporting the light source does not need to be additionally provided. Thus, it is possible to increase the surface area of the globe portion 10 and to correspondingly increase a light distribution angle. Further, by providing the light source 13 away from the power circuit 22, it is possible to prevent the power circuit 22 from increasing in temperature.

Second Embodiment

Figure 8A:
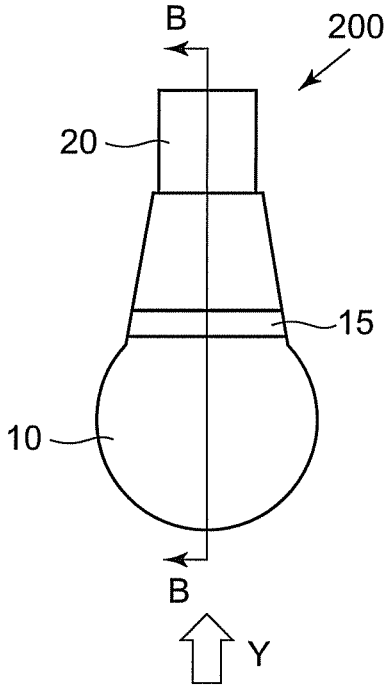
FIG. 8 are configuration diagrams of a lighting apparatus according to a second embodiment.
Figure 8B:
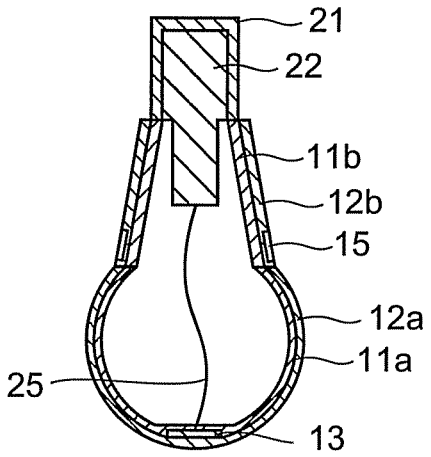
Figure 8C:
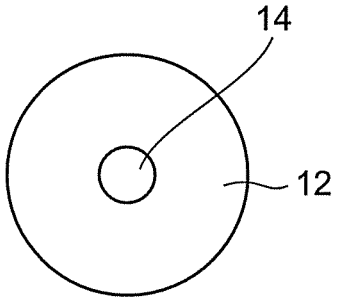

FIG. 8 are configuration diagrams of a lighting apparatus 200 according to a second embodiment. Specifically, FIG. 8A is a full view of the lighting apparatus 200. FIG. 8B is a cross-sectional diagram of the lighting apparatus 200 that is taken along a plane including the axis (B-B line) of FIG. 8A. FIG. 8C is an overhead view of the lighting apparatus 200 as viewed in the arrow Y direction of FIG. 8A.

The lighting apparatus 200 is different from the lighting apparatus 100 according to the first embodiment in that a globe portion 10 includes a second member 15. It should be noted that the same configurations as those of the lighting apparatus 100 according to the first embodiment will be denoted by the same reference symbols and descriptions thereof will be omitted.

The second member 15 is a member that is provided on a second outer surface near a discontinuous portion of a light guiding member 12 (boundary between head portion 12*a* and body portion 12*b*) and that reflects, into the body portion 12*b*, part of light, which is guided inside the head portion 12*a* and enters the body portion 12*b*, and diffuses another part of the light to transmit it therethrough to an external space. The second member 15 changes a reflection angle of the light, which enters the body portion 12*b*, on an interface between the body portion 12*b* and the external space so that the light satisfies a total reflection condition.

It should be noted that, for example, a beam splitter may be used for the second member 15 as in the first member 14. Alternatively, an opalescent glass, an opalescent acryl, an opalescent polycarbonate, or the like may be used instead of the beam splitter.

The light, which has been guided inside the head portion 12*a* while satisfying the total reflection condition, may not satisfy the total reflection condition anymore when the light inputs into the body portion 12*b* discontinuously connected to the head portion 12*a* in the discontinuous portion of the light guiding member 12.

In view of this, by providing such a discontinuous portion with the second member 15, the reflection angle of the light, which enters the body portion 12*b*, on the interface between the light guiding member 12 and the external space is changed. Accordingly, the light entering the body portion 12*b* is caused to satisfy the total reflection condition again and guided inside the body portion 12*b*.

It should be noted that, also in the case where the head portion 12*a* has a large curvature, light guiding may be prevented as with the discontinuous portion. In this case, it is also possible to partially provide the second outer surface of the head portion 12*a* with the second member 15.

According to the lighting apparatus 200 of this embodiment, by providing the second member 15 to the portion in which the light may not satisfy the total reflection condition anymore due to a change of the reflection angle thereof, it is possible to assist the light guiding inside the light guiding member 12. Accordingly, it becomes possible to achieve more uniform luminance distribution over the entire surface of the light guiding member 12.

Third Embodiment

Figure 9A:
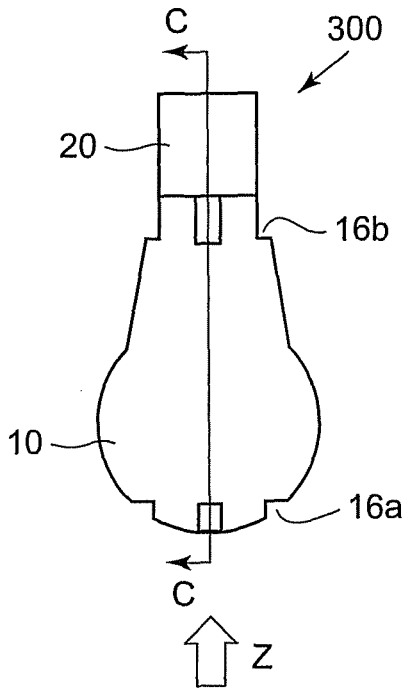
FIG. 9 are configuration diagrams of a lighting apparatus according to a third embodiment.
Figure 9B:
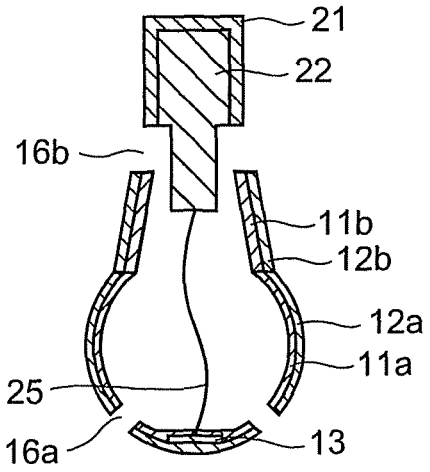
Figure 9C:
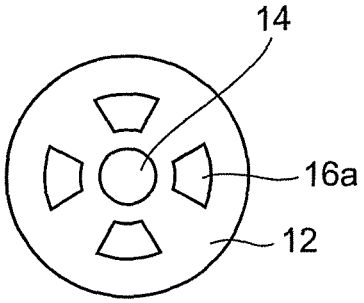

FIG. 9 are configuration diagrams of a lighting apparatus 300 according to a third embodiment. Specifically, FIG. 9A is a full view of the lighting apparatus 300. FIG. 9B is a cross-sectional diagram of the lighting apparatus 300 that is taken along a plane including the axis (C-C line) of FIG. 9A. FIG. 9C is an overhead view of the lighting apparatus 300 as viewed in the arrow Z direction of FIG. 9A.

The lighting apparatus 300 is different from the lighting apparatus 100 according to the first embodiment in that a heat-transfer member 11 and a light guiding member 12 of a globe portion 10 include one or more first through-holes 16*a* and one or more second through-holes 16*b*. It should be noted that that the same configurations as those of the lighting apparatus 100 according to the first embodiment will be denoted by the same reference symbols and descriptions thereof will be omitted.

In this embodiment, each of the heat-transfer member 11 and the light guiding member 12 includes the one or more first through-holes 16*a* and the one or more second through-holes 16*b*. The first through-holes 16*a* pass through the heat-transfer member 11 and the light guiding member 12. The air flows into a cavity of the heat-transfer member 11. Similarly, the second through-holes 16*b* pass through the heat-transfer member 11 and the light guiding member 12. The air flows out of the cavity of the heat-transfer member 11 to an external space. It should be noted that the first through-holes 16*a* are desirably provided near ends of the heat-transfer member 11 and the light guiding member 12 in the direction of gravitational force. Accordingly, the air ascends from near the ends in the direction of gravitational force along the outline of the lighting apparatus 300 due to natural convection, and hence it becomes easy for the air to flow into the cavity of the heat-transfer member 11.

The air having a low temperature flows into an inside of the heat-transfer member 11 through the first through-holes 16*a* due to natural convection, and hence the air inside the heat-transfer member 11 decreases in temperature. Thus, not only the first outer surface of the heat-transfer member 11 but also the first inner surface of the heat-transfer member 11 functions as a heat transfer surface. After being flowed into the inside of the heat-transfer member 11 and heated, the air flows through the second through-holes to the external space of the lighting apparatus 300.

Accordingly, it is possible to enhance heat transfer performance of the lighting apparatus 300. It should be noted that the first inner surface of the heat-transfer member 11 may be provided with a fin or the like (not shown) for enlarging a heat transfer area.

Figure 10A:
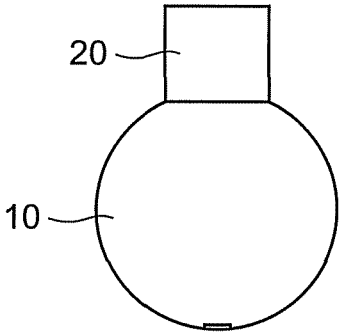
FIG. 10 are configuration diagrams each showing a modification of a globe portion.
Figure 10B:
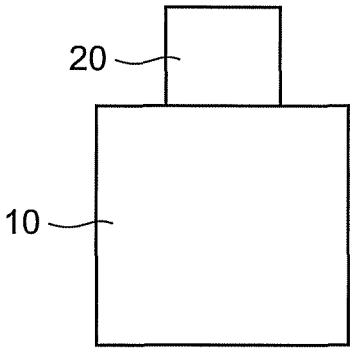

The globe portion 10 having a typical bulb shape (spherical head portion and circular truncated cone shaped body portion) is used as an example in each of the above-mentioned embodiments. Various shapes, for example, a lighting apparatus (FIG. 10A) including a spherical globe portion 10 and a lighting apparatus (FIG. 10B) including a columnar globe portion 10 as shown in FIG. 10 may be adopted.

Alternatively, in order to achieve asymmetrical light distribution, the globe portion 10 having an ellipsoidal cross-section perpendicular to the center axis of the lighting apparatus may be used, for example.

Additionally, a rechargeable battery may be provided inside the heat-transfer member 11 of the lighting apparatus. Accordingly, by charging the lighting apparatus upon energization, the lighting apparatus is enabled to continue light emission for a certain time even when a power failure occurs. In addition to this, an injector or the like that injects a fire extinguishing agent when a fire occurs may be provided inside the heat-transfer member 11 of the lighting apparatus.

According to the lighting apparatus of at least one of the above-mentioned embodiments, it is possible to enhance heat transfer performance without increasing the size of the lighting apparatus.

While certain embodiments have been described, these embodiments have been presented by way of example only, and are not intended to limit the scope of the inventions. Indeed, the novel methods and systems described herein may be embodied in a variety of the other forms; furthermore, various omissions, substitutions and changes in the form the methods and systems described herein may be made without departing from the sprit of the inventions. The accompanying claims and their equivalents are intended to cover such forms or modifications as would fall within the scope and spirit of the inventions.

What is claimed is:

1. A lighting apparatus, comprising:

at least one light source that emits light;

a heat-transfer member including an outer surface on which the at least one light source is disposed, the heat-transfer member forming a hollow space;

a light guiding member that contacts along the outer surface of the heat-transfer member and covers the at least one light source and at least part of the outer surface of the heat-transfer member; and a reflection member that is provided in contact with an outer surface of the light guiding member and to be opposed to the at least one light source via the light guiding member, wherein the at least one light source is provided at an end of the heat-transfer member in a direction of a center axis of the lighting apparatus substantially and is interposed between the heat-transfer member and the light guiding member, part of the light emitted by the at least one light source is reflected totally at an interface between the light guiding member and an outside and inside of the light guiding member and propagates to an interior of the light guiding member, and both the heat-transfer member and the light guiding member surround the hollow space, part of an outer surface of the light guiding member facing the at least one light source having another curved surface which is different from a curve of the peripheral part of the outer surface of the light guiding member and which reflects light emitted from the at least one light source toward an extending direction of the light guiding member, the reflecting member having another curved surface which faces the at least one light source and reflects light emitted from the at least one light source toward an extending direction of the light guiding member, and the curved surface of the light guiding member and the other curved surface of the reflecting member contact along the extending direction of the light guiding member with each other.

2. The lighting apparatus according to claim 1, wherein the light guiding member is fixed to the outer surface of the heat-transfer member adhesively.

3. The lighting apparatus according to claim 1, further comprising a cylinder-shaped cap that is provided to part of the heat-transfer member, wherein the at least one light source is located on a center axis of the cylinder-shaped cap and the heat-transfer member.

4. The lighting apparatus according to claim 1, further comprising a cylinder-shaped cap that is provided to part of the heat-transfer member, wherein the heat-transfer member is rotatable with respect to the cylinder-shaped cap about a center axis of the cylinder-shaped cap and the heat-transfer member.

5. The lighting apparatus according to claim 1, further comprising a through-hole that passes through the heat-transfer member and the light guiding member.

6. The lighting apparatus according to claim 1, wherein the reflection member transmits there through part of light emitted by the at least one light source, to an outside of the lighting apparatus.

7. The lighting apparatus according to claim 1, wherein the light guiding member guides light emitted by the at least one light source along the outer surface of the heat-transfer member and radiates the light to an outside of the lighting apparatus.

8. The lighting apparatus according to claim 1, wherein the heat-transfer member includes a spherical head portion and a first circular truncated cone shaped body portion, wherein the spherical head portion and the first body portion being integrally formed, and wherein the light guiding member includes a spherical head portion and a second circular truncated cone shaped body portion.

9. The lighting apparatus according to claim 8, wherein the first circular truncated cone shaped body portion includes an opening at one end on a center axis direction of a cylinder-shaped cap and the heat-transfer member.

10. The lighting apparatus according to claim 1, wherein the light guiding member includes a scattering mark on a surface of the light guiding member for scattering light.

11. The lighting apparatus according to claim 1, wherein the at least one light source is provided at an end of the heat-transfer member in a direction of gravitational force between the heat-transfer member and the light source.

12. The lighting apparatus according to claim 1, wherein the at least one light source is disposed at an end of the lighting apparatus on a center axis direction of a cylinder-shaped cap and the heat-transfer member, so that the light from the at least one light source is symmetrically guided inside the light guiding member so that the light is symmetric about the at least one light source.

13. The lighting apparatus according to claim 1, further comprising, a first member that reflects into the light guiding member a part of light, which is inputted from the at least one light source into the light guiding member, and that transmits a part of light to an external space of the lighting apparatus.

14. The lighting apparatus according to claim 13, wherein the first member is a beam splitter.

15. The lighting apparatus according to claim 1, further comprising the at least one light source is provided on a center axis of a cylinder-shaped cap, and the reflection member is provided at least on the center axis.

16. The lighting apparatus according to claim 1, further comprising one or more first through-holes proximate a cap portion of the lighting apparatus, the one or more first through-holes passing through the heat-transfer member and the light guiding member; and one or more second through-holes spaced apart from any one of the one or more first through-holes, the one or more second through-holes passing through the heat-transfer member and the light guiding member.

17. The lighting apparatus according to claim 1, further comprising a cylinder-shaped cap provided at part of the heat-transfer member, wherein the light guiding member is formed to extend to the cylinder-shaped cap substantially.

18. The lighting apparatus according to claim 1, further comprising a cylinder-shaped cap provided at part of the heat-transfer member, wherein the heat-transfer member is formed to extend to the cylinder-shaped cap substantially.

19. The lighting apparatus according to claim 1, further comprising a cylinder-shaped cap provided at part of the heat-transfer member, wherein the heat-transfer member is formed to extend along an inner surface of the light guiding member to the cylinder-shaped cap substantially.

20. The lighting apparatus according to claim 1, further comprising a cylinder-shaped cap provided at part of the heat-transfer member, wherein an inner surface of the heat-transfer member contacts air.

21. A lighting apparatus, comprising:

at least one light source that emits light;

a heat-transfer member including an outer surface on which the at least one light source is disposed, the heat-transfer member including a first spherical head portion and a first circular truncated cone shaped body portion which is integrally formed and forming a hollow space;

a light guiding member that includes a second spherical head portion and a second circular truncated cone shaped body portion, the light guiding member contacting along the outer surface of the heat-transfer member and covers the at least one light source and at least part of the outer surface of the heat-transfer member; and a reflection member that is provided on an outer surface of the light guiding member and near a portion of the light guiding member between the second spherical head portion and the second circular truncated cone shaped body portion, wherein the at least one light source is provided at an end of the heat-transfer member in a direction of a center axis of the lighting apparatus substantially and is interposed between the heat-transfer member and the light guiding member, part of the light emitted by the at least one light source is reflected totally at an interface between the light guiding member and an outside and inside of the light guiding member and propagates to an interior of the light guiding member, and both the heat-transfer member and the light guiding member surround the hollow space, and part of the light which propagates in the second spherical head portion and enters the second circular truncated cone shaped body portion satisfies a total reflection condition so that the part of the light is guided along an extending direction of the second body portion; and another reflection member that is provided in contact with an outer surface of the light guiding member and to opposed to the at least one light source via the light guiding member, wherein part of an outer surface of the light guiding member facing the at least one light source having another curved surface which is different from a curve of the peripheral part of the outer surface of the light guiding member and which reflects light emitted from the at least one light source toward an extending direction of the light guiding member, the other reflection member having another curved surface which faces the at least one light source and reflects light emitted from the at least one light source toward an extending direction of the light guiding member, and the curved surface of the light guiding member and the other curved surface of the other reflection member contact along the extending direction of the light guiding member with each other.

22. The lighting apparatus according to claim 1, wherein the light guiding member has a thermal resistance R of 3 K/w or less.

23. The light apparatus according to claim 1, wherein the light guiding member has a thermal resistance R of 3 K/w or less when the thermal resistance R is expressed by l/kA where l is a thickness of the light guiding member, k is a thermal conductivity of the light guiding member, and A is a surface area of the light guiding member.

24. The light apparatus according to claim 21, wherein the light guiding member has a thermal resistance R of 3 K/w or less.

25. The light apparatus according to claim 21, wherein the light guiding member has a thermal resistance R of 3 K/w or less when the thermal resistance R is expressed by l/kA where l is a thickness of the light guiding member, k is a thermal conductivity of the light guiding member, and A is a surface area of the light guiding member.

* * * * *